US012247363B1

(12) United States Patent
Bertas

(10) Patent No.: US 12,247,363 B1
(45) Date of Patent: Mar. 11, 2025

(54) VEHICLE BARRIER SYSTEM AND METHOD OF CONSTRUCTION THEREOF

(71) Applicant: Anthony J. Bertas, Jackson, MS (US)

(72) Inventor: Anthony J. Bertas, Jackson, MS (US)

( * ) Notice: Subject to any disclaimer, the term of this patent is extended or adjusted under 35 U.S.C. 154(b) by 0 days.

(21) Appl. No.: 17/921,852

(22) PCT Filed: May 25, 2022

(86) PCT No.: PCT/US2022/030825

§ 371 (c)(1),
(2) Date: Oct. 27, 2022

(87) PCT Pub. No.: WO2023/229584

PCT Pub. Date: Nov. 30, 2023

(51) Int. Cl.
*E01F 15/14* (2006.01)

(52) U.S. Cl.
CPC ..... *E01F 15/14* (2013.01)

(58) Field of Classification Search
CPC ..... E01F 15/14
USPC ..... 404/6–8, 72
See application file for complete search history.

(56) References Cited

U.S. PATENT DOCUMENTS 3,678,815 A * 7/1972 Younker ..... E01F 15/083 404/6
3,762,113 A 10/1973 O'Mullan et al.
4,260,296 A 4/1981 Hilfiker
4,307,973 A * 12/1981 Glaesener ..... E01F 15/085 404/6
4,324,508 A 4/1982 Hilfiker et al.
4,348,133 A * 9/1982 Trent ..... E01F 15/083 404/6
4,494,892 A 1/1985 Wojciechowski
4,496,264 A 1/1985 Casey
4,929,125 A 5/1990 Hilfiker
4,954,009 A 9/1990 Kellison
4,961,673 A 10/1990 Pagano et al.
4,964,750 A 10/1990 House et al.
4,971,475 A 11/1990 Castonguay et al.
(Continued)

FOREIGN PATENT DOCUMENTS

CN 112127243 A * 12/2020 ..... C08L 19/003
CN 216515722 U 5/2022
(Continued)

OTHER PUBLICATIONS

International Search Report, mailed Sep. 8, 2022 for Appl. No. PCT/US22/30825, filed May 25, 2022.
(Continued)

*Primary Examiner* — Raymond W Addie
(74) *Attorney, Agent, or Firm* — AdamsIP, LLC; Stephen Thompson; J. Hunter Adams

(57) ABSTRACT

A vehicle barrier system is provided. The system includes a barrier structure integrally connected to a moment slab. The barrier structure includes a front curb section connected to two side curb sections that each extend at an angle from the front curb section in a direction toward the moment slab. The front and side curb sections are formed by a casing into which concrete is poured. The barrier structure and moment slab are cast-in-place concrete structures. The barrier structure may be installed on top of an elevated structure so that a vehicle may back up to the front curb section and dump material from the elevated structure.

17 Claims, 11 Drawing Sheets

(56) References Cited

U.S. PATENT DOCUMENTS

| | | | | |
|---|---|---|---|---|
| 5,145,278 | A * | 9/1992 | Lohrmann | E01F 15/0476 404/6 |
| 5,360,286 | A * | 11/1994 | Russell | E01F 15/086 404/9 |
| 5,468,098 | A | 11/1995 | Babcock | |
| 5,471,811 | A | 12/1995 | House et al. | |
| D385,362 | S | 10/1997 | Rossetti | |
| 5,746,538 | A * | 5/1998 | Gunness | E01F 15/0453 404/6 |
| D431,082 | S | 9/2000 | Jaros | |
| 6,131,786 | A | 10/2000 | Kamps | |
| 6,679,649 | B1 | 1/2004 | Capolupo | |
| 8,568,057 | B2 | 10/2013 | Rodriguez | |
| 9,187,869 | B2 | 11/2015 | Rainey | |
| D756,256 | S | 5/2016 | Hinebaugh et al. | |
| 9,598,827 | B1 * | 3/2017 | Pavloff, Jr. | E01F 15/088 |
| 9,663,907 | B2 | 5/2017 | Rainey | |
| 9,783,982 | B2 | 10/2017 | Dinmore et al. | |
| 10,344,444 | B2 | 7/2019 | Durkin et al. | |
| 10,344,474 | B2 | 7/2019 | Dinmore et al. | |
| D917,323 | S | 4/2021 | Ghuman et al. | |
| 11,352,753 | B2 * | 6/2022 | Habodasz | E01F 15/02 |
| D1,023,342 | S | 4/2024 | Milligan | |
| 2003/0223812 | A1 * | 12/2003 | Vandenbossche | E01F 15/083 404/6 |
| 2004/0076468 | A1 | 4/2004 | McKay et al. | |
| 2009/0208286 | A1 | 8/2009 | Sutton | |
| 2010/0272509 | A1 | 10/2010 | Ritke | |
| 2013/0136544 | A1 | 5/2013 | McKittrick | |
| 2014/0308072 | A1 | 10/2014 | Sagy | |
| 2016/0145818 | A1 | 5/2016 | Schultz et al. | |
| 2016/0208454 | A1 | 7/2016 | Arya | |
| 2023/0250593 | A1 | 8/2023 | Craver | |

FOREIGN PATENT DOCUMENTS

| | | | |
|---|---|---|---|
| KR | 10-0400676 | B1 | 10/2003 |
| KR | 10-1828341 | B1 | 3/2018 |
| WO | 2014/004892 | A1 | 1/2014 |
| WO | 2023209400 | A1 | 11/2023 |

OTHER PUBLICATIONS

Written Opinion of the International Searching Authority, mailed Sep. 8, 2022 for Appl. No. PCT/US22/30825, filed May 25, 2022.

Design U.S. Appl. No. 29/843,993, titled Casing for Concrete Vehicle Barrier, filed Jun. 24, 2022.

"Truck Safety Barriers for Mining Sites," Fowkes et al., Anziam Journal 0(2017), 1-17.

International Search Report, mailed Apr. 1, 2024 for Appl. No. PCT/US23/81319, filed Nov. 28, 2023.

Written Opinion of the International Searching Authority, mailed Apr. 1, 2024 for Appl. No. PCT/US23/81319, filed Nov. 28, 2023.

Temporary Vertical Concrete Barriers, date first available Sep. 27, 2016 [online], Available from the internet URL: https://www.eliteprecast.co.uk/safety-security-barriers/temporary-vertical-concrete-barriers/ (Year: 2016).

Concrete Barrier, date first available Sep. 1, 2020 [online], Available from the internet URL: https://www.safesitefacilities.co.uk/products/1-5m-concrete-barriers (Year: 2020).

* cited by examiner

VEHICLE BARRIER SYSTEM AND METHOD OF CONSTRUCTION THEREOF

CROSS REFERENCES

This application is a U.S. National Stage application of PCT Application No. PCT/US22/30825, filed on May 25, 2022, which application is incorporated herein in its entirety by reference.

FIELD OF THE INVENTION

The present disclosure relates generally to a vehicle barrier system including a curb structure and an approach slab connected to the curb structure.

BACKGROUND

Large trucks are commonly used in open pit aggregate mines to haul rock, soil, or other types of aggregate and to dump aggregate into large feed hoppers used to direct the aggregate to an aggregate crusher or conveyer. Feed hoppers are often placed adjacent to a mechanically stabilized earth (MSE) retaining wall or other type of stabilized earthen or rock wall so that a mining truck can drive to the top of the wall and dump aggregate downward into the hopper. Moreover, in other applications, various types of vehicles capable of dumping material may be utilized to dump ore, debris, refuse, or other materials from other types of elevated structures. Trucks used for hauling aggregate are extremely large and may weigh many tons when fully loaded with material. Serious accidents may occur during operation of such trucks, causing damage to the truck or other equipment on site and injury to personnel. For instance, incidents have been documented in which mining trucks have backed over a retaining wall and caused serious injury or even death to the driver of the truck and also catastrophic damage to both the truck and the hopper. Such damage may not only be expensive but also time-consuming to repair, which may result in significant delays in restarting operations after an accident. Truck drivers often work long hours, which may contribute to the frequency with which such accidents occur.

To mitigate the probability of vehicle accidents at mining sites and similar dumping sites, a dump curb is often utilized at the top of the retaining wall or other elevated structure to prevent trucks from backing over the retaining wall. The dump curb is installed in a position to stop the rear wheels of the truck in a suitable location in which material can be dumped from the truck to a position below the retaining wall or other elevated structure. Such curbs are typically constructed of concrete and run along the top of the retaining wall. Due to the size and weight of large dumping vehicles such as mining trucks, repeated impacts to the dump curb often cause damage to the curb, which compromises the structural integrity of the curb. This damage may cause the dump curb to eventually fail, thereby increasing the likelihood of an accident. Furthermore, even when utilizing a dump curb, incidents have also been documented in which large vehicles have veered off of the approach to the dump curb when reversing into position to dump material, which may still result in the truck falling down on the opposing side of a retaining wall or down an embankment.

SUMMARY

A vehicle barrier system and a method of constructing the vehicle barrier system are provided. The vehicle barrier system comprises a barrier structure that is integrally connected to a moment slab. The barrier structure and moment slab may be installed on an earthen support structure, which may comprise soil retained by a retaining wall. The moment slab functions as an approach slab for a vehicle approaching the barrier structure, which may be installed on a top side of the retaining wall to prevent vehicles from accidentally backing or driving over the retaining wall and falling downward to the ground below. The integrated design of the vehicle barrier system and construction elements of the system allow the system to be utilized for extremely large vehicles, such as mining trucks used to dump aggregate into feed hoppers at mining sites or for other types of large vehicles used for dumping or hauling material. The barrier structure and moment slab may also be installed on other types of structures elevated above a lower surface, such as a foundation wall or a stabilized rock wall.

The barrier structure comprises a front curb section and two opposing side curb sections each connected to the front curb section. Each of the side curb sections extends from opposing ends of the front curb section at an angle to the front curb section. The front curb section and side curb sections define a concrete form having a hollow interior. The concrete form may be in the form of a metal casing designed for wet concrete slurry to be poured into the casing to fill the hollow interior of the concrete form. The front curb section has a front wall and a rear wall, and each of the side curb sections also has a front wall and a rear wall, which define the hollow interior of the concrete form. The barrier structure includes a base attached to the rear wall of the front curb section and to each respective rear wall of the side curb sections. The base comprises a generally horizontal piece of material. The rear wall of the front curb section and each respective rear wall of the side curb sections extend upwardly from the base. The front wall of the front curb section and each respective front wall of the side curb sections has a lower edge positioned above the base so as to define an open portion of the concrete form, which allows direct access into the hollow interior of the concrete form. Concrete and reinforcing bars may be installed through the open portion of the concrete form.

The moment slab is connected to both the front curb section and to the side curb sections. At least a portion of the moment slab is disposed between the side curb sections. The moment slab comprises concrete, which forms the approach slab on which a vehicle may be operated to approach the barrier structure. The concrete extends from the portion of the moment slab on which the vehicle is operated through the open portion of the concrete form and upwardly into the hollow interior of the concrete form. Reinforcing bars may be utilized within the concrete of the moment slab. Before pouring the wet concrete slurry, the reinforcing bars may be tied to studs attached to interior surfaces of the front and side curb sections and disposed within the hollow interior of the concrete form. In addition, vertically oriented lateral support members may also be utilized to prevent lateral movement of the vehicle barrier system relative to the earthen support structure on which the system is installed.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

The present disclosure provides a vehicle barrier system and a method of constructing the vehicle barrier system in accordance with the independent claims. Preferred embodiments of the claimed invention are reflected in the dependent claims. The claimed invention can be better understood in view of the embodiments described and illustrated in the present disclosure. In general, the present disclosure reflects preferred embodiments of the invention. The attentive reader will note, however, that some aspects of the disclosed embodiments extend beyond the scope of the claims. To the respect that the disclosed embodiments indeed extend beyond the scope of the claims, the disclosed embodiments are to be considered supplementary background information and do not constitute definitions of the invention per se.

In the Summary above and in this Detailed Description, and the claims below, and in the accompanying drawings, reference is made to particular features, including method steps, of the invention as claimed. In the present disclosure, many features are described as being optional, e.g. through the use of the verb "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features, or with all three of the three possible features. It is to be understood that the disclosure in this specification includes all possible combinations of such particular features. For example, where a particular feature is disclosed in the context of a particular aspect or embodiment, or a particular claim, that feature can also be used, to the extent possible, in combination with/or in the context of other particular aspects or embodiments, and generally in the invention as claimed.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 7:
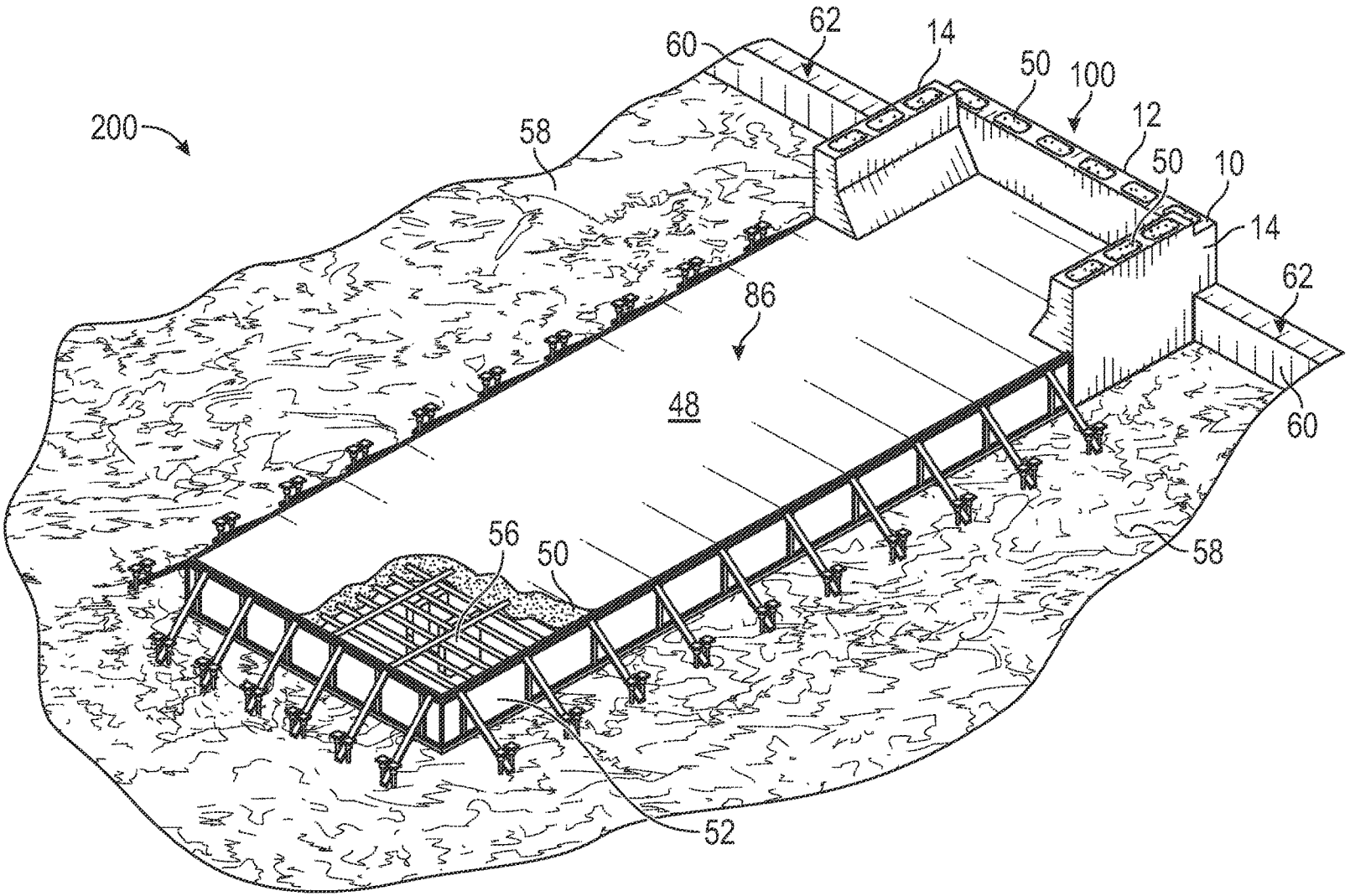
FIG. 7 shows a perspective view of a vehicle barrier system in accordance with the present disclosure.
Figure 11:
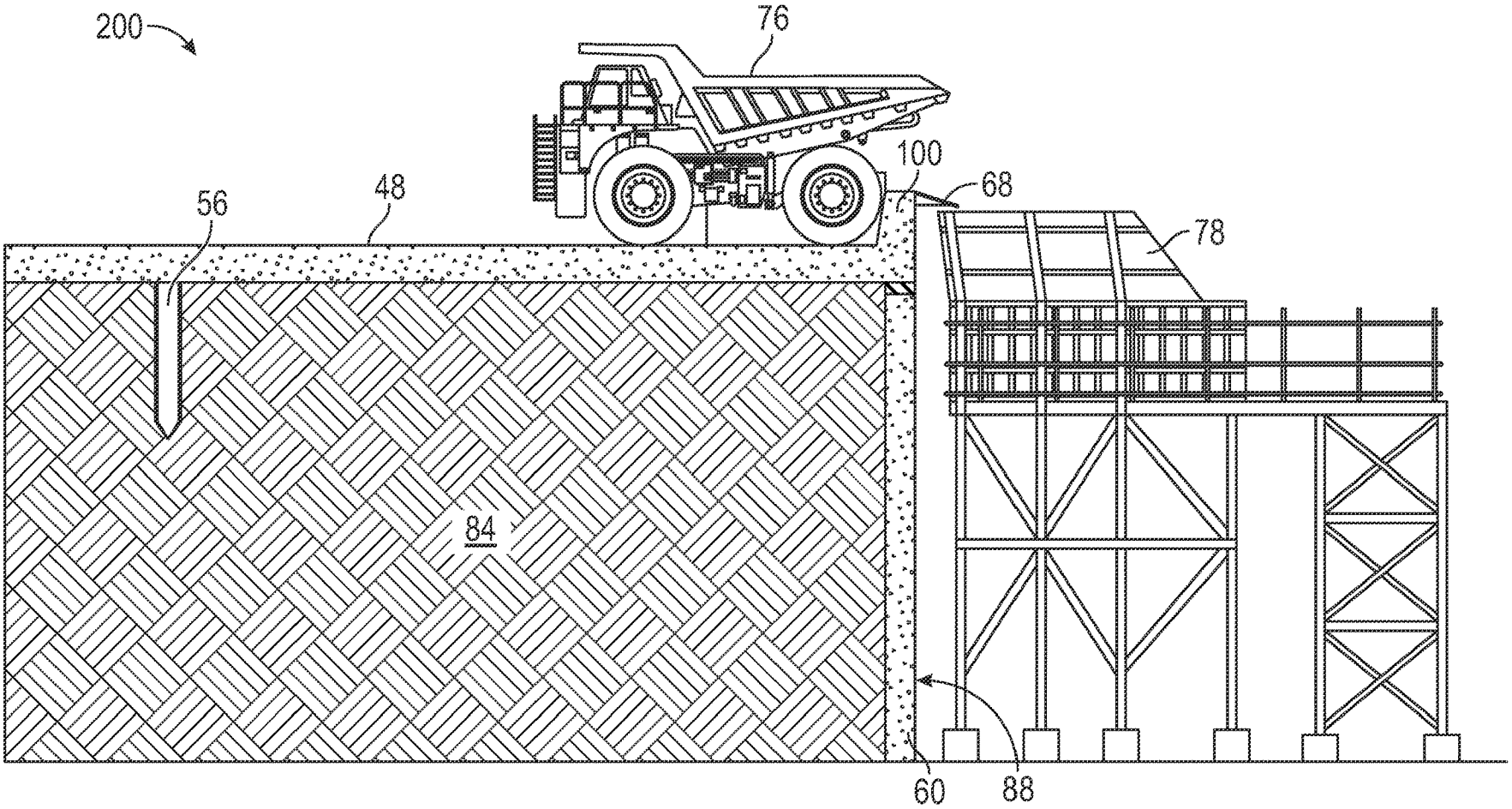
FIG. 11 shows a cross-sectional view of a vehicle barrier system installed on top of a retaining wall and being used by a mining truck to back up to a hopper in accordance with the present disclosure.

A vehicle barrier system 200 and a method of constructing the vehicle barrier system 200 are provided. As shown in FIG. 7, the vehicle barrier system comprises a barrier structure 100 that is integrally connected to a moment slab 48. As best seen in FIGS. 11-14, the barrier structure 100 and moment slab 48 may be installed on an elevated support structure, which may allow a vehicle 76 to approach the barrier structure 100 and dump material from the elevated support structure. For instance, as shown in FIG. 11, the barrier structure 100 and moment slab 48 may be installed on an earthen support structure 84 comprising soil retained by a retaining wall 60. The moment slab 48 functions as an approach slab for the vehicle 76 to approach the barrier structure 100, which may be installed on a top side 62 of the retaining wall 60 to prevent vehicles 76 from accidentally backing or driving over the retaining wall 60 and falling downward to the ground below. The moment slab 48 has an upper surface 86 upon which a vehicle 76 may be operated. The integrated design of the vehicle barrier system 200 and construction elements of the system allow the system to be utilized for extremely large vehicles 76, such as mining trucks 76 used to dump aggregate into feed hoppers 78 at mining sites. The system 200 may also be utilized for other large vehicles 76, such as dump trucks, garbage trucks, semi-trailer trucks, box trucks, front-end loaders, or other similar types of vehicles capable of dumping or hauling material.

Figure 1:
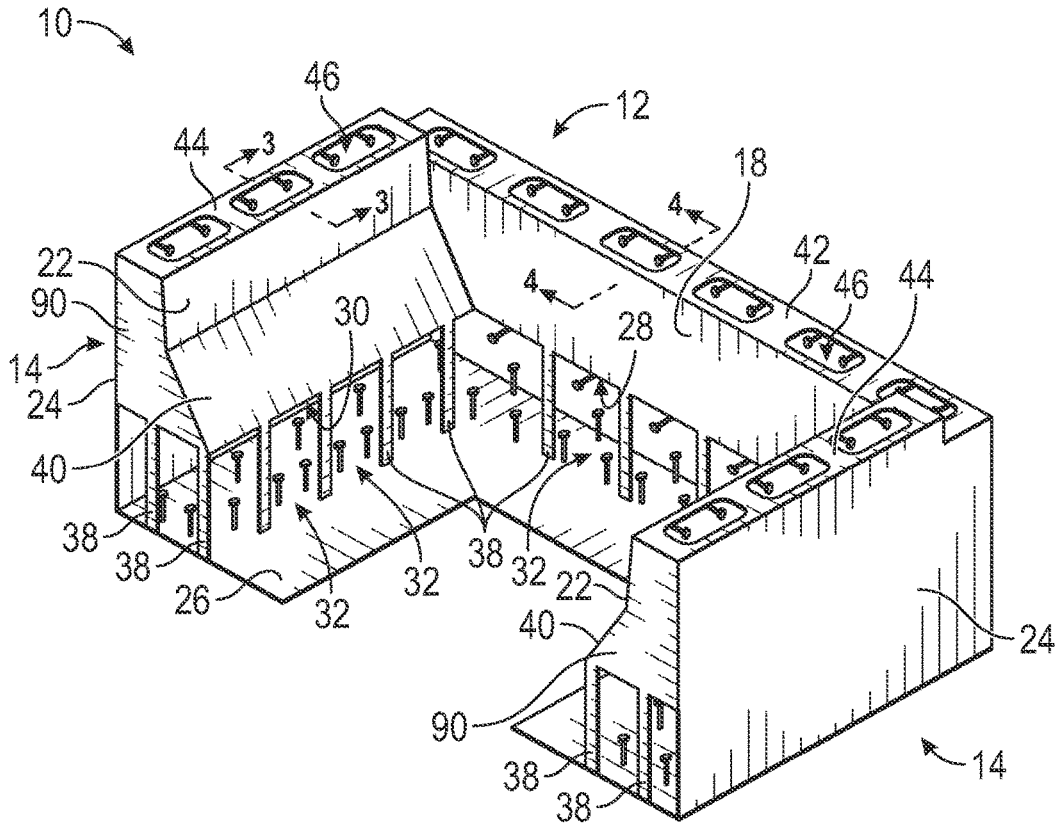
FIG. 1 shows a perspective view of a concrete form structure for constructing a vehicle barrier in accordance with the present disclosure.
Figure 2:
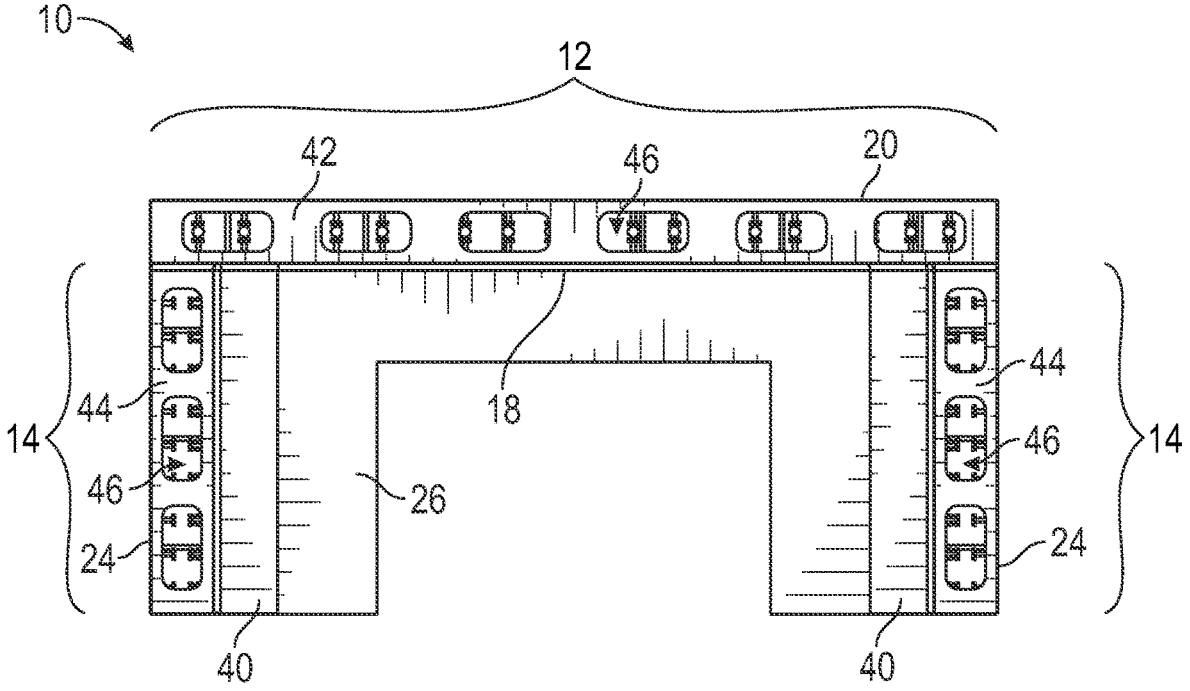
FIG. 2 shows a top plan view of a concrete form structure for constructing a vehicle barrier in accordance with the present disclosure.
Figure 9:
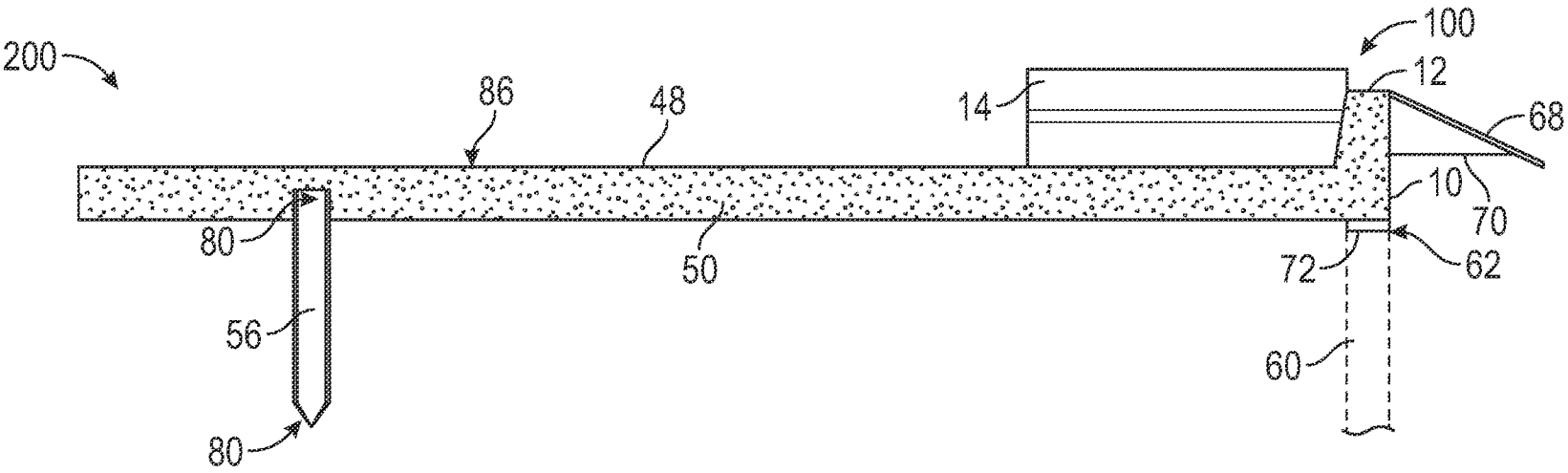
FIG. 9 shows a cross-sectional view of a vehicle barrier system installed on top of a retaining wall in accordance with the present disclosure.
Figure 10:
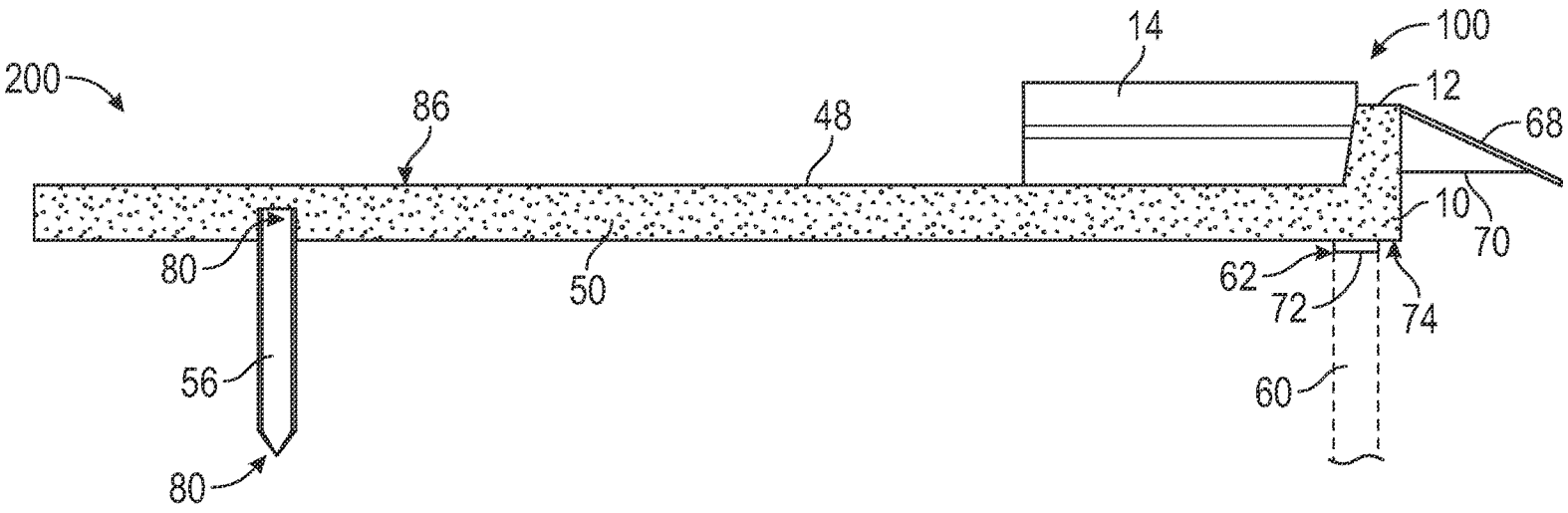
FIG. 10 shows a cross-sectional view of a cantilevered vehicle barrier system installed on top of a retaining wall in accordance with the present disclosure.
Figure 12:
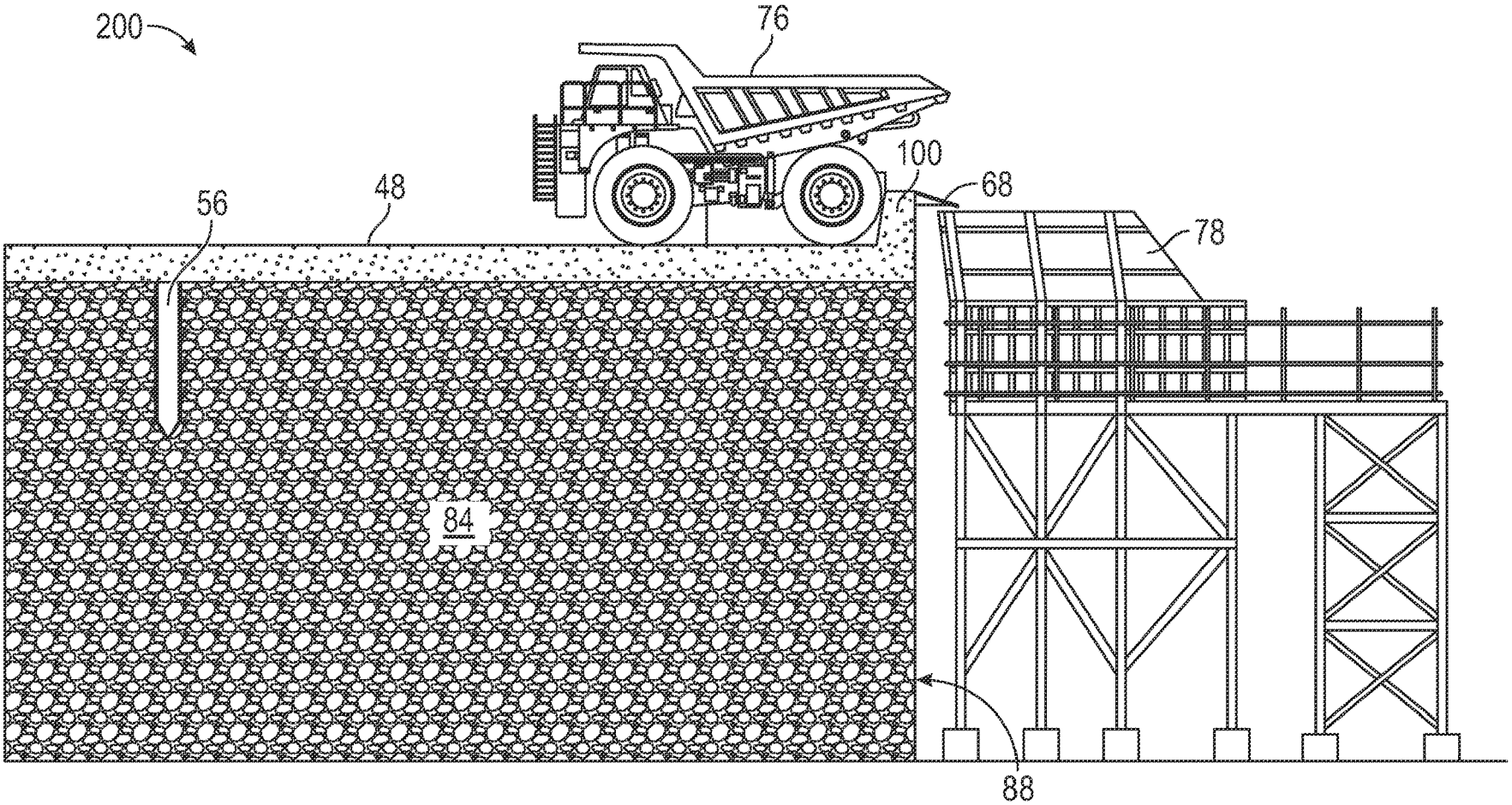
FIG. 12 shows a cross-sectional view of a vehicle barrier system installed on top of a stable rock wall and being used by a mining truck to back up to a hopper in accordance with the present disclosure.

The barrier structure 100 comprises a concrete form 10 that is filled with concrete 50 during installation of the system 200. FIGS. 1-5 illustrate the concrete form 10 of the barrier structure 100 before installation. The barrier structure 100 comprises a front curb section 12 and two opposing side curb sections 14 each connected to the front curb section 12 at opposing ends of the front curb section 12. The barrier structure 100 also comprises a base 26 to which the front curb section 12 and side curb sections 14 are attached. At least a portion of the moment slab 48 is disposed between the side curb sections 14, though the moment slab 48 may extend away from the front curb section 12 beyond the ends of the side curb sections 14, as shown in FIG. 7. The barrier structure 100 prevents a vehicle 76 from backing or driving beyond limits defined by the front curb section 12 and side curb sections 14. For instance, when backing a mining truck 76 to dump material into a hopper 78 positioned on an opposing side of the retaining wall 60, the front curb section 12 may be contacted by wheels of the truck 76 when positioning the truck 76 for dumping, as shown in FIGS. 11 and 12. Further, the side curb sections 14 prevent the truck 76 from veering off of the moment slab 48 when backing up to the front curb section 12. Thus, the front curb section 12 may be positioned directly over a top side 62 of the retaining wall 60, as shown in FIGS. 9-11. As such, the front curb section 12 is preferably a generally straight section of curb, which may be positioned above a generally straight section of a retaining wall 60 or adjacent to an edge of a similar type of elevated support structure. Each of the side curb sections 14 extends from the opposing ends of the front curb section 12 at an angle to the front curb section 12. Each of the side curb sections 14 is also preferably a generally straight section of curb and preferably extends from the front curb section 12 at an angle of approximately 90 degrees to the front curb section 12. Thus, as best seen in FIG. 2, the concrete form 10 preferably has a "U" shape but with the side curb sections 14 being generally perpendicular to the front curb section 12 at the point of attachment of each side curb section 14. Both side curb sections 14 extend from the front curb section 12 in the same direction, which is a direction toward the moment slab 48 so that at least a portion of the moment slab 48 is disposed between the side curb sections 14. The side curb sections 14 may alternatively extend from the front curb section 12 at an angle that deviates slightly from a 90-degree angle. For instance, the side curb sections 14 may be angled outwardly from the front curb section 12 at an angle slightly greater than 90 degrees. Alternatively, the transition from the front curb section 12 to each of the side curb sections 14 may be a curved corner section that effectively forms an angle of approximately 90 degrees between the front curb section 12 and each of the side curb sections 14.

Figure 3:
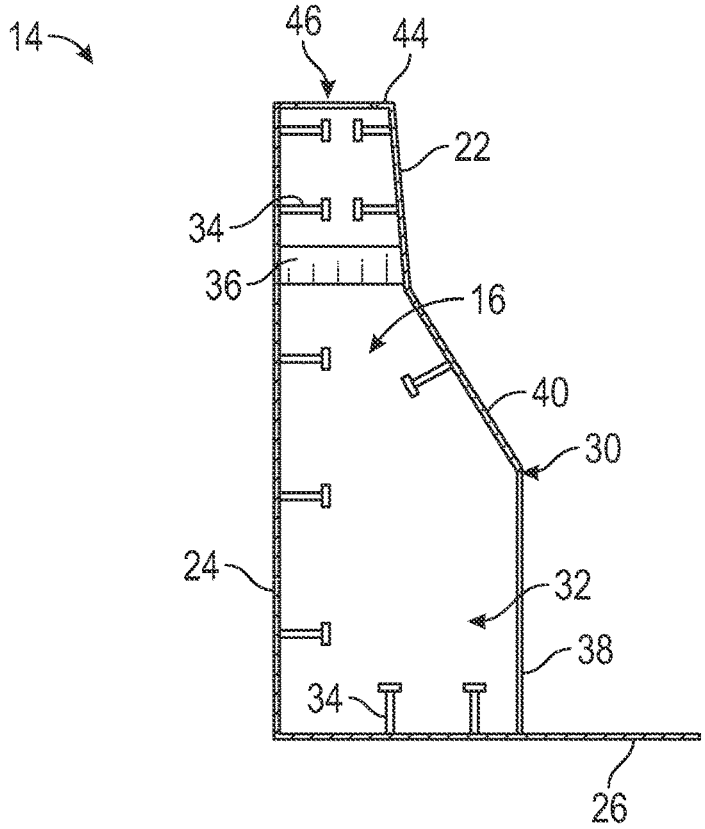
FIG. 3 shows a cross-sectional view of a concrete form structure for constructing a vehicle barrier in accordance with the present disclosure as viewed along line 3-3.
Figure 4:
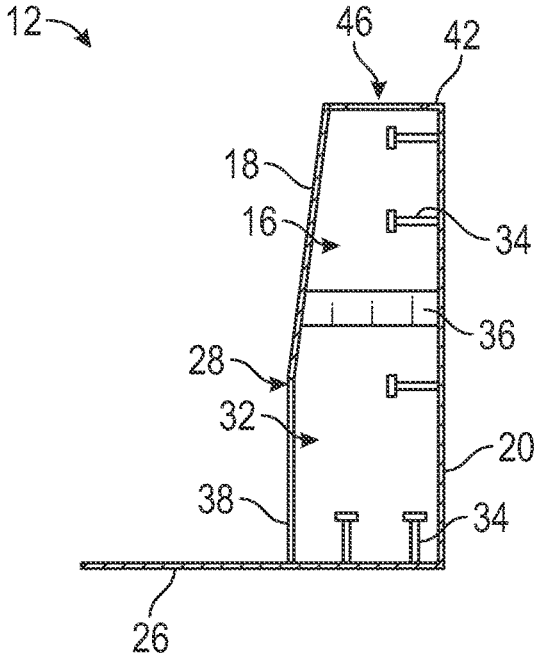
FIG. 4 shows a cross-sectional view of a concrete form structure for constructing a vehicle barrier in accordance with the present disclosure as viewed along line 4-4.

The front curb section 12 and side curb sections 14 define the concrete form 10, which has a hollow interior 16, as best seen in cross-sectional views shown in FIGS. 3 and 4, which show one of the side curb sections 14 and the front curb section 12, respectively. The concrete form 10 comprises a casing designed for wet concrete slurry to be poured into the casing to substantially fill the hollow interior 16 of the concrete form 10. The front curb section 12 has a front wall 18 and a rear wall 20, and each of the side curb sections 14 also has a front wall 22 and a rear wall 24, which define the hollow interior 16 of the concrete form 10. The hollow interior 16 may extend continuously from a first one of the side curb sections 14 into the front curb section 12 and into the second side curb section 14. The rear walls 20 and 24 generally face outwardly from the concrete form 10 in a direction facing away from the moment slab 48 when the system 200 is installed, as shown in FIG. 7. The front walls 18 and 22 generally face inwardly toward the moment slab 48 when the system 200 is installed.

The barrier structure 100 includes a base 26 attached to the rear wall 20 of the front curb section 12 and to each respective rear wall 24 of the side curb sections 14. The base 26 comprises a generally horizontal piece of material, which preferably has a continuous horizontal surface without openings in the surface. The rear wall 20 of the front curb section 12 and each respective rear wall 24 of the side curb sections 14 extend upwardly from the base 26. As best seen in FIGS. 3 and 4, the rear walls 20 and 24 may preferably extend upwardly from the base 26 at an angle of 90 degrees so that the rear walls 20 and 24 are generally vertical when the system 200 is installed. As shown in FIG. 4, the front wall 18 of the front curb section 12 may preferably be angled slightly toward the moment slab 48 so that the front wall 18 is not vertical but slopes slightly outward from the top of the front wall 18 to the bottom of the front wall 18. The slightly angled front wall 18 may provide a larger contact area for the tires of the vehicle 76 when the tires impact the front wall 18, which may help to avoid a pinch point between the front wall 18 of the front curb section 12 and the vehicle tires when the tires are bumped against the front wall 18. In addition, as best seen in FIGS. 1 and 3, the front walls 22 of the side curb sections 14 may preferably have flared bottom sections 40 that are angled outwardly from an upper portion of the front walls 22 as the flared bottom sections 40 approach the moment slab 48. Thus, the flared bottom section 40 of each side curb section 14 is angled in a direction away from the rear wall 24 of the side curb section 14 as the flared bottom section 40 slopes downward to the moment slab 48. An upper portion of the front walls 22 of the side curb sections 14 above the flared bottom sections 40 may also be angled slightly toward the moment slab 48, which may be at approximately the same angle to the moment slab 48 as the front wall 18 of the front curb section 12. The flared bottom sections 40 may then be angled at a smaller angle than the upper portion of the wall 22 relative to an upper surface 86 of the moment slab 48. The flared bottom sections 40 may be angled to an extent that the flared bottom sections 40 will contact a wheel of a vehicle 76 before the upper portion of the wall 22 will contact the wheel if the vehicle inadvertently veers at an angle into one of the side curb sections 14, in which case the vehicle 76 would not be properly aligned when backing up to the front curb section 12. Thus, the flared bottom sections 40 may help to guide the vehicle 76 by immediately notifying an operator of the vehicle 76 upon contact with one of the flared bottom sections 40 that the vehicle is not properly aligned so that the operator may realign the vehicle. By providing such early notification to the operator before a more substantial impact with the barrier structure 100, the flared bottom sections 40 may prevent damage to the wheels or other portions of the vehicle 76 while the barrier structure 100 also prevents a potential accident.

As best seen in FIGS. 1, 3, and 4, the front wall 18 of the front curb section 12 has a lower edge 28 positioned above the base 26, and each respective front wall 22 of the side curb sections 14 also has a lower edge 30 positioned above the base 26 so as to define an open portion 32 of the concrete form 10, which allows direct access into the hollow interior 16 of the concrete form 10. The open portion 32 extends vertically between an upper surface of the base 26 and the lower edges 28 and 30 of the front and side curb sections 12 and 14. The open portion 32 also extends along a length of each of the side curb sections 14 and the front curb section 12. During installation of the system 200, the open portion 32 of the concrete form 10 allows reinforcing bars ("rebar") 54 and concrete 50 used in constructing the moment slab 48 to extend into the interior 16 of the concrete form 10 in order to integrally connect the barrier structure 100 to the moment slab 48. When the system 200 is installed, the upper surface 86 of the moment slab 48 may be generally level with the lower edge 28 of the of the front wall 18 of the front curb section 12 and with the lower edge 30 of each respective front wall 22 of the side curb sections 14, as best seen in FIG. 7.

As best seen in FIG. 1, the barrier structure 100 may comprise a plurality of vertical support members 38, which are connected to the concrete form 10. Each respective one of the vertical support members 38 may be connected to the base 26 and to either the lower edge 28 of the front wall 18 of the front curb section 12 or to the lower edge 30 of the front wall 22 of a respective one of the side curb sections 14. As best seen in FIGS. 3 and 4, the barrier structure 100 may further comprise a plurality of internal support members 36 disposed within the hollow interior 16 of the concrete form 10. Each respective one of the internal support members 36 may be connected to the front wall 18 and to the rear wall 20 of the front curb section 12 or may be connected to the front wall 22 and to the rear wall 24 of a respective one of the side curb sections 14. Both the vertical support members 38 and the internal support members 36 may provide additional structural support to the concrete form 10 to help ensure structural integrity of the casing that forms the concrete form 10 during installation and operation of the system 200.

As best seen in FIGS. 1-4, the front curb section 12 may have an upper wall 42 connecting the front wall 18 and the rear wall 20 of the front curb section 12, and each of the side curb sections 14 may also have an upper wall 44 connecting the front wall 22 and the rear wall 24 of each respective one of the side curb sections 14. As best seen in FIGS. 1 and 2, the upper wall 42 of the front curb section 12 may have a plurality of openings 46 extending through the upper wall 42 of the front curb section 12, and the upper wall 44 of each of the side curb sections 14 may also have a plurality of openings 46 extending through the upper wall 44 of each of the side curb sections 14. Each of the openings 46 preferably has a generally rectangular shape with rounded corners. The openings 46 provide a location into which wet concrete slurry may be poured into the interior 16 of the concrete form 10. The openings 46 also allow air to be displaced from the interior 16 of the concrete form 10 as the concrete slurry is poured into the interior 16 and fills the concrete form 10. The interior 16 of the concrete form 10 may be defined by the front walls 18, 22 and rear walls 20, 24 of the front curb section 12 and side curb sections 14, as well as by the base 26 and the upper walls 42, 44 of the front and side curb sections 12, 14. The interior 16 is open along the open section 32 of the concrete form 10 and may be delineated generally by the vertical support members 38 of both the front and side curb sections 12, 14. As best seen in FIGS. 1 and 2, the base 26 may extend inwardly past the vertical support members 38 to provide a base that covers a greater surface area to enhance stability of the base 26. As best seen in FIG. 1, the side curb sections 14 may each have an end 90, which may also be attached to the base 26 with vertical support members 38. In addition, the open section 32 may extend to the ends 90 of each side curb section 14.

Figure 5:
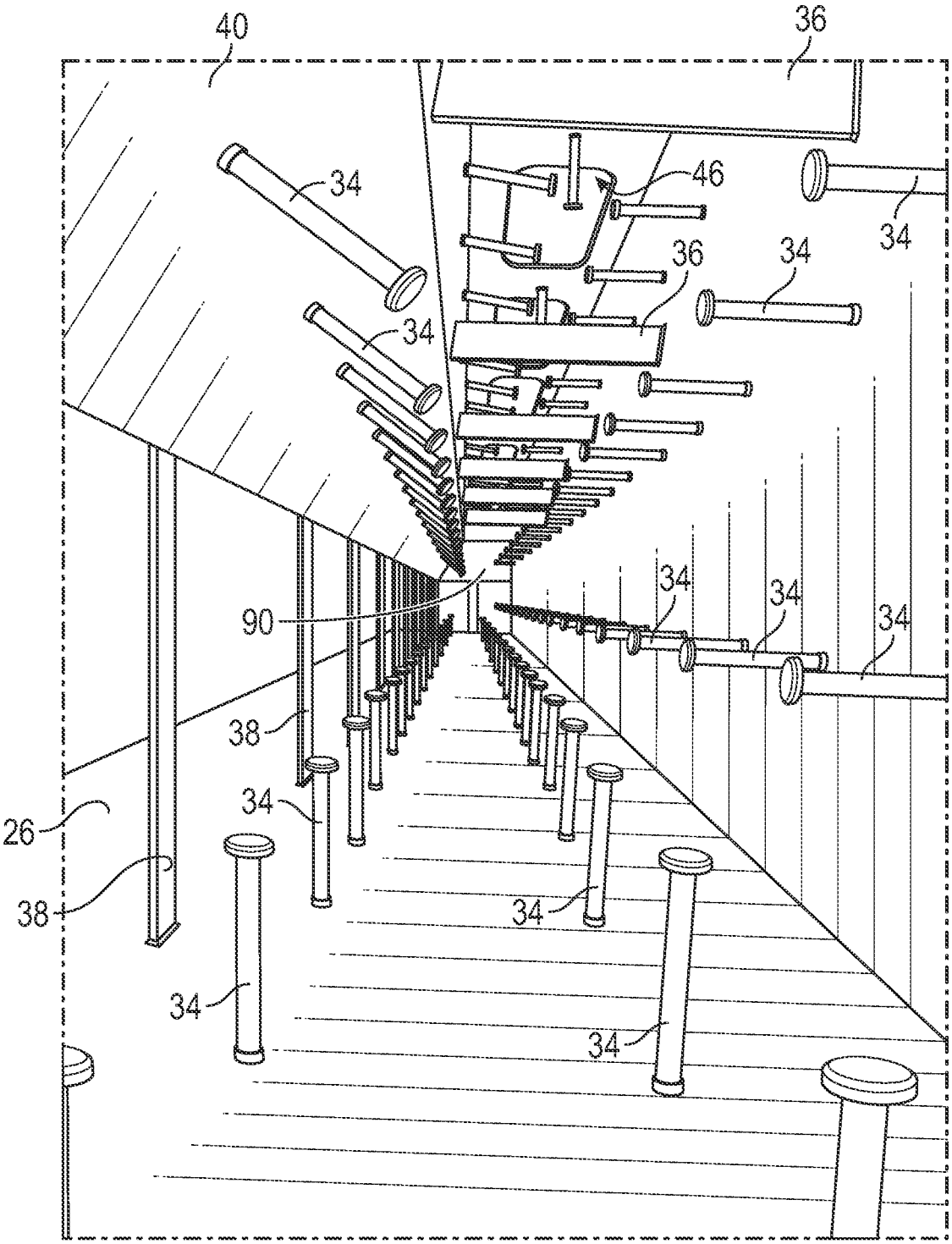
FIG. 5 shows a perspective view of an internal portion of a concrete form structure for constructing a vehicle barrier in accordance with the present disclosure.

As best seen in FIGS. 3-5, the concrete form 10 may further comprise a plurality of studs 34 disposed within the interior 16 of the concrete form 10. Each of the studs 34 may be attached to the front walls 18, 22 or to the rear walls 20, 24 of the front curb section 12 and side curb sections 14, or may be attached to the base 26. Studs 34 may also be optionally attached to the upper walls 42, 44 of the front and side curb sections. Each of the studs 34 may extend inwardly into the interior 16 of the concrete form 10 from the surface to which the stud 34 is attached, preferably in a direction approximately perpendicular to the attachment surface. The studs 34 may be arranged in a pattern, such as in rows extending along a length of the front curb section 12 and the side curb sections 14, as shown in FIG. 5, which shows the interior of one of the side curb sections 14 viewed in a direction looking toward the end 90 of the side curb section 14. The studs 34 ensure that the concrete 50 poured into the interior 16 of the form 10 does not delaminate from the concrete form 10 over time. The studs 34 may also provide positioning and tie points for the rebar 54 when installing the system 200.

The moment slab 48 comprises concrete 50, which forms the slab on which a vehicle 76 may be operated upon an upper surface 86 of the slab to approach the barrier structure 100. The moment slab 48 is connected to both the front curb section 12 and to the side curb sections 14 by the concrete 50 that extends from the moment slab 48 through the open portion 32 of the concrete form 10 and upwardly into the hollow interior 16 of the concrete form 10 into both the front curb section 12 and the side curb sections 14 to form a monolithic structure that includes both the moment slab 48 and the barrier structure 100. The concrete 50 extends both horizontally from the moment slab 48 into the hollow interior 16 of the concrete form 10 through the open portion 32 and then upwardly further into the interior 16 so that the concrete 50 may substantially fill the interior 16 of the concrete form 10. As best seen in FIG. 7, at least a portion of the moment slab 48 is disposed between the side curb sections 14, though the moment slab 48 preferably extends past the ends 90 of the side curb sections 14. Reinforcing bars 54 may be utilized within the concrete 50 of the moment slab 48. Before pouring the wet concrete slurry, rebar 54 may first be tied to some of the studs 34 attached to interior surfaces of the front and side curb sections 12, 14 within the interior 16 of the concrete form 10.

Figure 6:
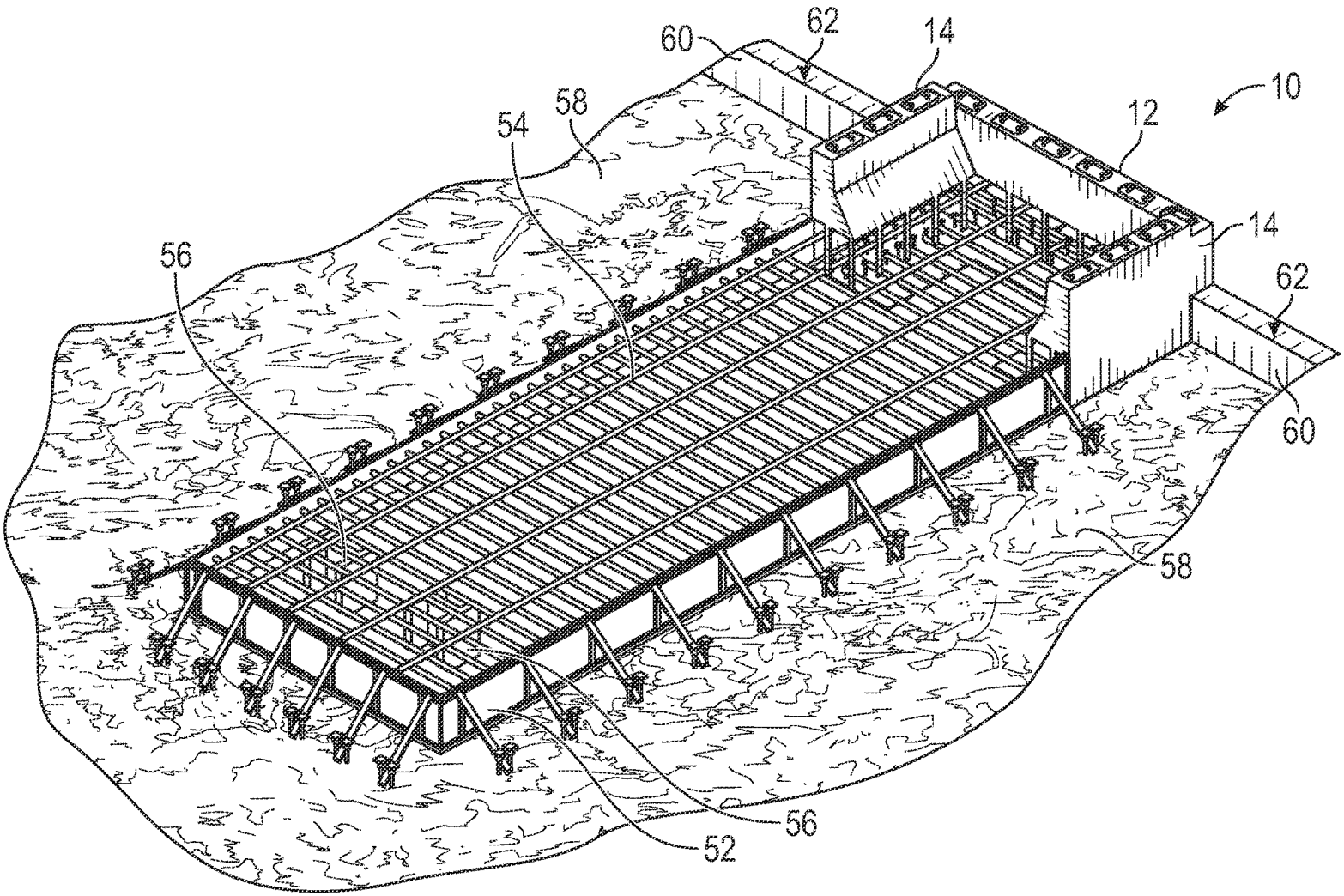
FIG. 6 shows a perspective view of a vehicle barrier system in a state of being constructed in accordance with the present disclosure.

The vehicle barrier system 200 may further comprise vertically oriented lateral support members 56, which may be utilized to anchor the moment slab 48 in order to prevent lateral movement of the vehicle barrier system 200 relative to the earthen support structure 84 on which the system 200 is installed. As shown in FIGS. 6 and 7, the system 200 may include two lateral support members 56 that are anchored in the concrete 50 of the moment slab 48 and in the earthen support structure 84. As best seen in FIGS. 9-12, each lateral support member 56 has an upper end 80 disposed within the concrete 50 of the moment slab 48 and a lower end 82 disposed within the earthen support structure 84. The lateral support members 56 may prevent shifting of the moment slab 48 and the connected barrier structure 100 after repeated impacts over time to the barrier structure 100 by a vehicle 76 during normal use of the system 200.

The vehicle barrier system 200 is designed to be constructed utilizing cast-in-place (CIP) concrete to form the moment slab 48 and to fill the interior 16 of the concrete form 10 of the barrier structure 100. Thus, the concrete form 10 remains in place after installation. The concrete 50, preferably in combination with rebar 54, provides a mechanical connection between the moment slab 48 and the barrier structure 100. The concrete 50 and rebar 54 may also provide flexural strength to the moment slab 48 to withstand long-term loading of large vehicles 76. The concrete 50 utilized in constructing the system preferably has a 4,000 pounds per square inch (approximately 27,580 kPa) minimum compressive strength at 28 days. The concrete form 10 structure may be constructed of steel or a similar high-strength, rigid material. For instance, the base 26 and the walls of the front and side curb sections 12, 14 may be constructed of three-eighths-inch (0.9525 cm) thick A36 mild steel. Vehicle 76 impacts directly contact the front walls 18, 22 of the barrier structure 100 so that the CIP concrete within the interior 16 of the concrete form 10 of the barrier structure 100 is not damaged by direct impacts. To construct the concrete form 10, the base 26 and the walls of the front and side curb sections 12, 14 may be welded together at appropriate locations. For instance, the rear walls 20 and 24 of the front curb section 12 and side curb sections 14, respectively, may be welded to the base 26. The upper walls 42 and 44 may also be welded to the front walls 18 and 22 and to the rear walls 20 and 24 of the front curb section 12 and side curb sections 14, respectively. In addition, the vertical supports 38 may be welded to both the base 26 and to the front walls 18 and 22 of the front curb section 12 and side curb sections 14, respectively. Portions of the front walls 22 of the side curb sections 14 may also be welded to the front wall 18 of the front curb section 12 to form seamless connections between all walls so that there is no unwanted leakage of concrete slurry during construction.

As shown in FIGS. 11 and 12, the vehicle barrier system 200 may be installed on an existing earthen support structure 84. The earthen support structure may include a retaining wall 60 that retains soil of the earthen support structure 84 upon which the moment slab 48 is positioned, as seen in FIG. 11. A portion of the base 26 of the barrier structure 100 may rest on a top side 62 of the retaining wall 60 that retains soil of the earthen support structure 84. The retaining wall 60 may have a vertical exterior face 88, and the rear wall 20 of the front curb section 12 may be vertically aligned with the face 88 of the retaining wall 60, as shown in FIGS. 9 and 11. Alternatively, as shown in FIG. 10, the system 200 may be installed so that the barrier structure 100 includes a cantilevered section 74 that extends past the face 88 of the retaining wall 60, which may allow for better positioning of the front curb section 12 relative to a dumping location, such as a hopper 78 for dumping aggregate into the hopper 78. Alternatively, as shown in FIG. 12, the vehicle barrier system 200 may be installed on an earthen support structure 84 that does not include a retaining wall, but instead has a stable rock wall having an exterior face 88, which may be generally aligned vertically with the rear wall 20 of the front curb section 12.

To install the vehicle barrier system 200, the lateral support members 56 may first be driven into an earthen support structure 84 to a suitable depth to anchor the system 200 in order to provide lateral stability of the moment slab 48 due to vehicles 76 moving onto and off of the approach slab and impacting the barrier structure 100 during normal operation. The lateral support members 56 may comprise steel bearing H-piles (such as HP14x73 steel piling), or alternatively, the lateral support members 56 may comprise concrete drilled shafts, which may preferably be concrete piles that are eighteen inches (approximately 45.7 cm) in diameter. The size and depths of the lateral support members 56 may be customized for a specific installation site based on the size and weight of the vehicles 76 to be used with the system 200 or other design considerations specific to the installation site. As best seen in FIGS. 6 and 7, fill material may then be added and a level subgrade surface 58 may be prepared on which the barrier structure 100 and moment slab 48 may be installed. The lateral support members 56 may be driven into the earthen support structure 84 so that the upper end 80 of each lateral support member 56 is disposed above the subgrade surface 58 before pouring the concrete slurry to form the moment slab 48.

As shown in FIGS. 9 and 10, a spacer 72 may be optionally installed on the top side 62 of the retaining wall 60 so that the spacer 72 is disposed between the base 26 of the barrier structure 100 and the top side 62 of the retaining wall 60. The spacer 72 may comprise an elastomeric material that functions as an expansion joint between the concrete form 10 and the retaining wall 60. The spacer 72 is preferably at least one inch (2.54 cm) thick and has a durometer measurement of 60-70 and a minimum tensile strength of 610 psi (approximately 4,205 kPa). The spacer 72 helps to minimize any point loading between the base 26 of the concrete form 10 structure and the top side 62 of the retaining wall 60 as well as to reduce any vibration transfer between these two structural components. The spacer 72 material may be placed along the entire length of the portion of the retaining wall 60 that is positioned directly below the concrete form 10. The prepared subgrade 58 may be generally level horizontally with the spacer 72 so that portions of the base 26 of the concrete form 10 may be placed onto both the spacer 72 and the prepared subgrade 58 with the base 26 being disposed in a generally horizontal position with the base 26 laying flat on the prepared subgrade 58. The width of the base 26, which preferably extends inwardly past vertical support members 38 toward a central portion of the moment slab 48, helps to ensure that the concrete 50 of the moment slab 48 does not leak through under the concrete form 10 as the concrete 50 is being installed. In addition, the width of the base 26 provides further stability so that the concrete form 10 may be cantilevered over the face 88 of the retaining wall 60.

The concrete form 10 may then be moved into position resting on the prepared subgrade 58 with a portion of the form 10 also positioned above the retaining wall 60. As best seen in FIGS. 6 and 7, portions of the retaining wall 60 may extend upwardly above the prepared subgrade 58 on either side of the barrier structure 100 so that the top side 62 of the wall 60 on either side of the barrier structure 100 is higher than the top side 62 of the portion of the wall 60 that is positioned under the barrier structure 100. To this end, additional concrete or other wall structure may be optionally installed onto the top of an existing retaining wall 60 during installation of the system 200 to extend the existing wall upwardly. Alternatively, initial design and construction of the retaining wall 60 may optionally include an indented section of the wall 60 sized to receive the concrete form 10.

Once the concrete form 10 is in place, the moment slab 48 may then be installed. The upper end 80 of each lateral support member 56 may be cut if necessary for the upper end 80 to be disposed within the concrete 50 of the slab 48. An approach slab concrete form 52 may be installed around a perimeter of the intended location of the moment slab 48 and at a desired slab height, which may be generally level with the lower edge 28 of the of the front wall 18 of the front curb section 12 and with the lower edge 30 of each respective front wall 22 of the side curb sections 14, as best seen in FIG. 6. Rebar 54 may also be installed within the perimeter of the approach slab concrete form 52 so that the rebar 54 will be disposed within the concrete 50 of the slab 48 after pouring concrete slurry to install the moment slab 48. The rebar 54 may be inserted through the open section 32 of the concrete form 10, and ends of the rebar 54 may be tied to studs 34 disposed within the interior 16 of the concrete form 10. The rebar 54 may be tied to studs 34 extending upwardly from the base 26 of the concrete form 10 or extending horizontally from the rear wall 20, 24 of the front curb section 12 or side curb sections 14.

Figure 8:
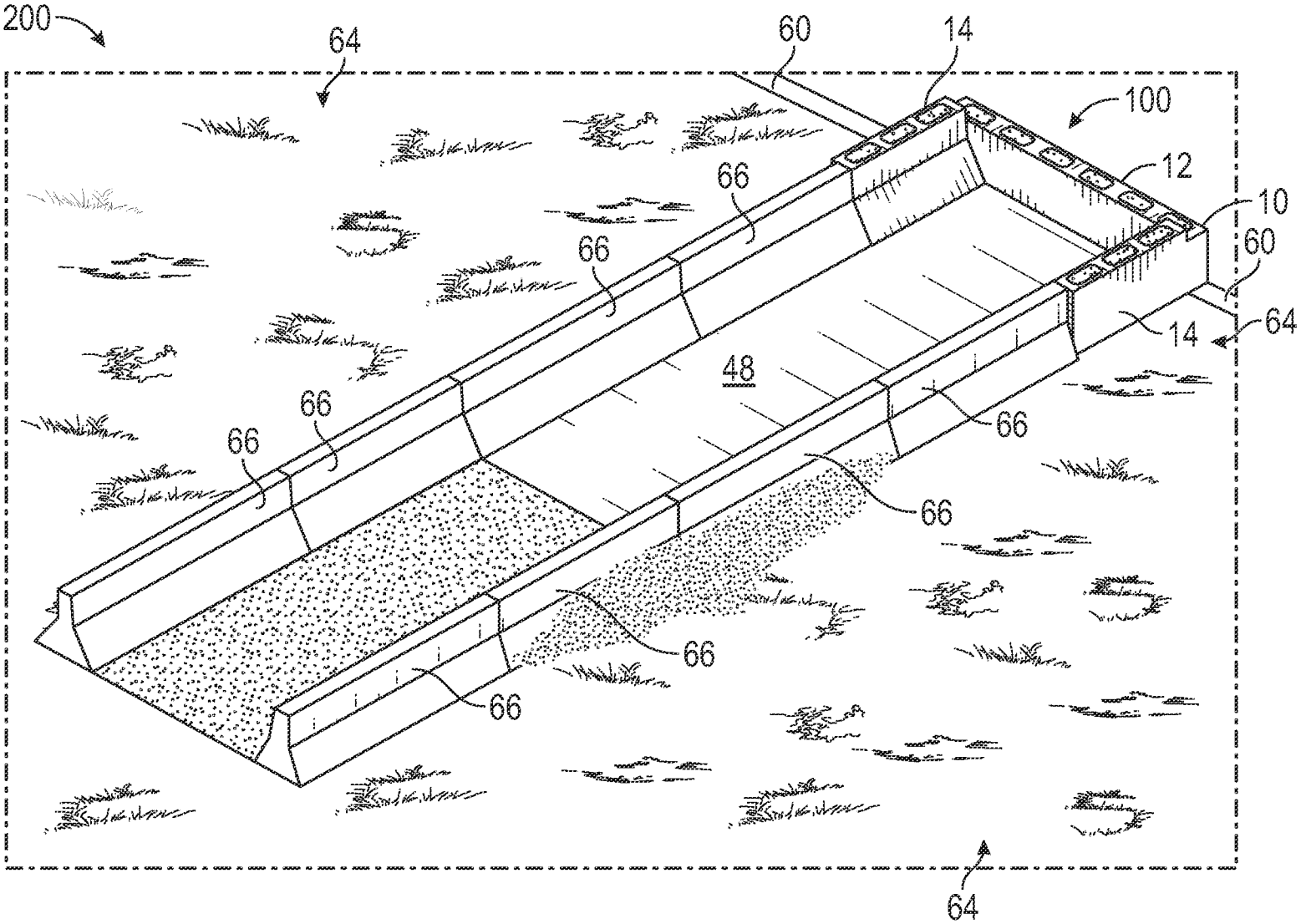
FIG. 8 shows a perspective view of a vehicle barrier system in accordance with the present disclosure.

As shown in FIG. 7, wet concrete slurry may then be poured within the approach slab concrete form 52 and also within the concrete form 10 of the barrier structure 100. Concrete slurry may first be poured into the approach slab concrete form 52 to construct the moment slab 48. The concrete slurry poured for the moment slab 48 may flow into the interior 16 of the concrete form 10 through the open portion 32 of the concrete form 10. Concrete slurry may then also be poured directly into the interior 16 of the concrete form 10 through openings 46. Concrete slurry may be poured into multiple individual openings 46 in both the front curb section 12 and the two side curb sections 14 so that concrete extends from the moment slab 48 into the interior 16 of the form 10 structure and upwardly toward the openings 46 of the front and side curb sections 12, 14. The concrete may be allowed to cure in order to form a monolithic structure in which the concrete 50, as well as the rebar 54, integrally connects the barrier structure 100 to the moment slab 48. Once the concrete 50 has cured, the approach slab concrete form 52 may be removed. The CIP concrete form 10 of the barrier structure 100 is a stay-in-place form that will remain in place throughout the life of the system 200. Concrete slurry may be poured into concrete form 10 through the openings 46 in the upper walls of the front curb section 12 and side curb sections 14 using an overhead or suspended concrete bucket until the interior 16 of the concrete form 10 is substantially filled with concrete, as best seen in FIGS. 7 and 8. The openings 46 may also provide connection points for loading, unloading, and placing the concrete form 10. The openings 46 may also provide worker access to the interior 16 of the concrete form 10 for installing rebar 54 and tying rebar 54 to studs 34 within the concrete form 10. In addition, the openings 46 may provide access for concrete vibration equipment during installation of the system 200.

As shown in FIG. 8, backfill material 64 may be installed around the moment slab 48 to provide a smooth approach for vehicles 76 moving onto the slab 48. The backfill material 64 may also be installed around the barrier structure 100 and up to an interior side of the retaining wall 60. As also shown in FIG. 8, one or more precast concrete barriers 66 may be optionally installed in a position aligned with the side curb sections 14. The precast concrete traffic barriers 66 may help to align the vehicles 76 when moving into position atop the approach slab 48 prior to reaching the front and side curb sections 12, 14 of the barrier structure 100. Additional backfill may also be optionally added on a back side of the precast concrete barriers 66 to provide additional support for the barriers 66. Past the end of the precast concrete barriers 66, earth berms may also be optionally installed.

As best seen in FIGS. 9-12, the barrier structure 100 may include a spanner plate 68, which may be attached to the rear wall 20 of the front curb section 12. The spanner plate 68 may at least partially span or cover a gap between the rear wall 20 of the front curb section 12 and a hopper 78. The spanner plate 68 may help to limit any potential loss of aggregate or other material being dumped from a vehicle 76 into the hopper 78 due to material falling between the barrier structure 100 and the hopper 78 when material is dumped. By preventing material from falling when being dumped, the spanner plate 68 may also aid worker safety by preventing dumped material from falling onto workers that may be working in an area at the bottom of the retaining wall 60. The spanner plate 68 may be constructed of the same material as the concrete form 10, which is preferably steel, and may be attached to the concrete form 10 by welding the spanner plate 68 to the rear wall 20 of the front curb section 12, preferably near the top of the rear wall 20. One or more support members 70 may also be welded to the rear wall 20 and to the spanner plate 68 to provide additional structural support for the spanner plate 68. The spanner plate 68 should not be attached to the hopper 78 because differences in vibration between the barrier structure 100 and the hopper 78 may cause damage to the barrier structure 100, including the spanner plate 68, or to the hopper 76 if these components are attached to each other. The width of the spanner plate 68 may be adjusted for different installation sites depending on the width of the gap to be spanned.

Figure 13:
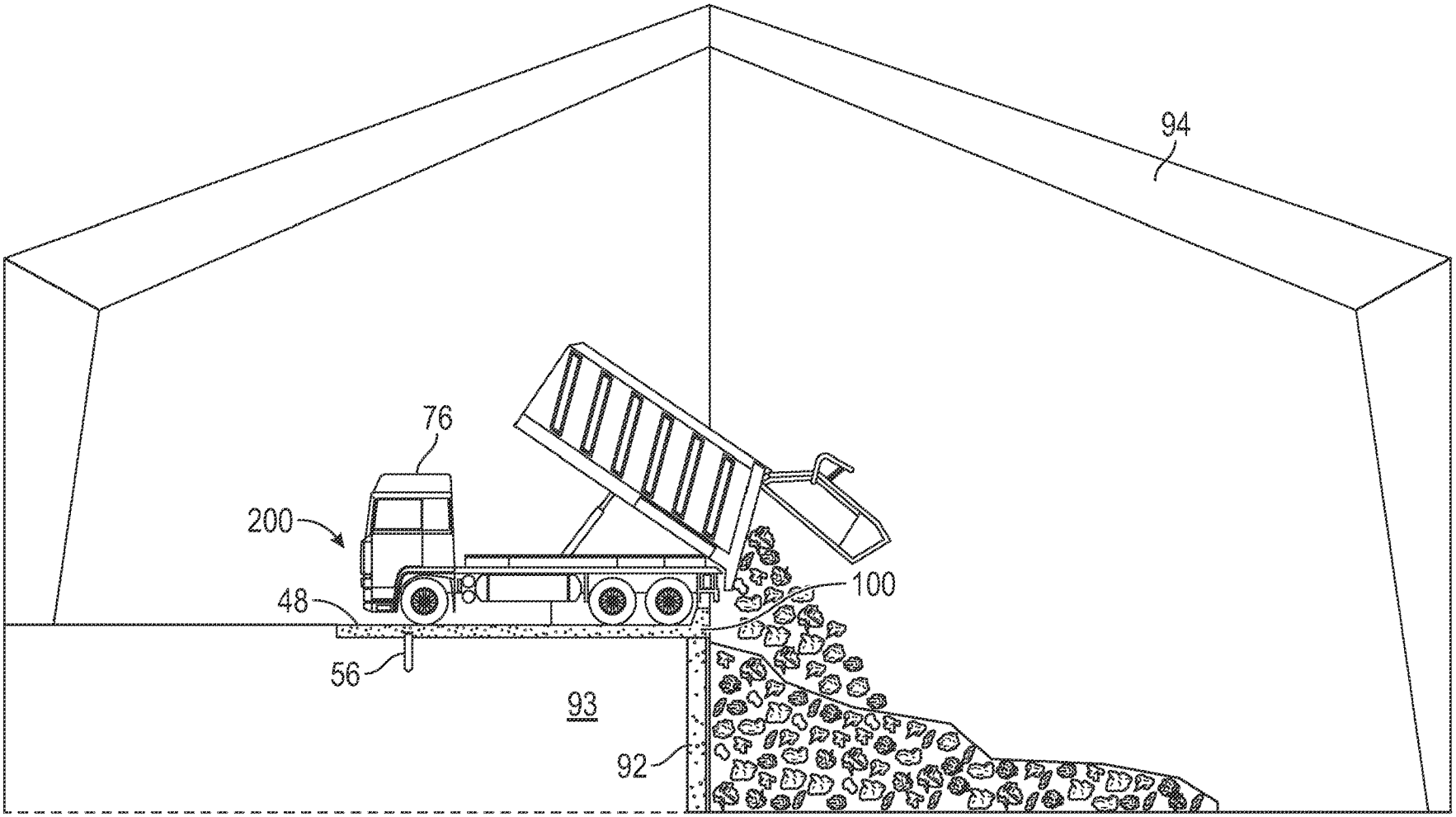
FIG. 13 shows a cross-sectional view of a vehicle barrier system installed on top of a foundation wall and being used by a dump truck to dump material from the top of the foundation wall in accordance with the present disclosure.
Figure 14:
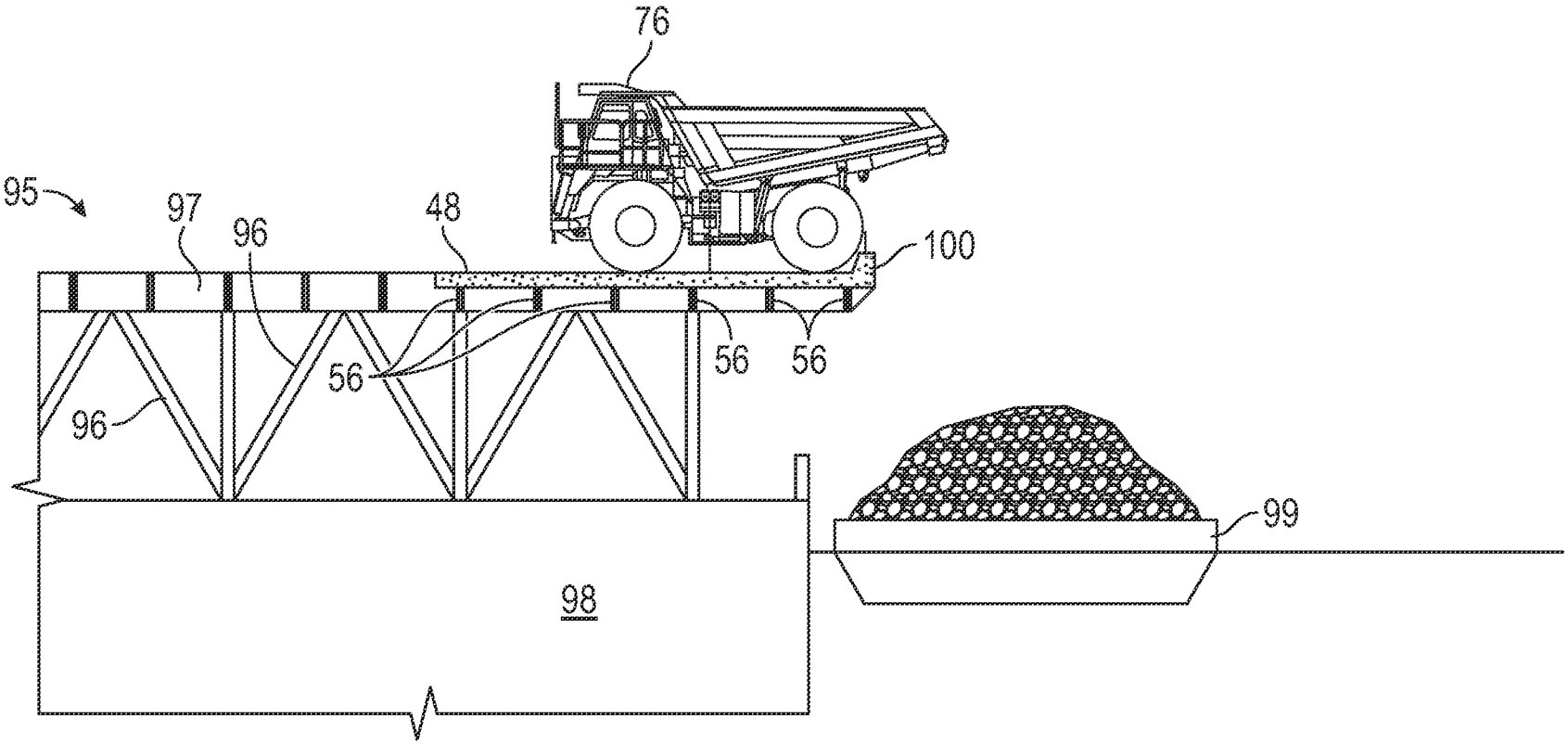
FIG. 14 shows a cross-sectional view of a vehicle barrier system installed on top of an elevated structure and being used by a mining truck to dump material from the elevated structure in accordance with the present disclosure.

As shown in FIG. 13, the barrier structure 100 may alternatively be installed on a top side of a foundation wall 92, which may form part of a foundation 93 of a building, which may include a roof structure 94 covering the foundation wall and the vehicle barrier system 200. Such an installation may be utilized when dumping refuse or other material inside of a warehouse or similar structure using a dump truck 76 or other type of dumping vehicle. Alternatively, as shown in FIG. 14, the barrier structure 100 and approach slab 48 may be installed on an elevated structure 95 rather than on an earthen structure 84 or foundation 93. The elevated structure 95 may be designed to support the moment slab 48 and barrier structure 100 in an elevated position for dumping material from the elevated structure 95. The elevated structure 95 may include support members 96 that support an elevated horizontal structure 97 having an upper surface suitable for driving a vehicle 76 on the surface. The moment slab 48 that is connected to the barrier structure 100 may form only a portion of the horizontal driving structure 97, as shown in FIG. 14, or it may optionally form all of the horizontal structure. As shown in FIG. 14, the system 200 may include a plurality of lateral support members 56, which may be disposed within the concrete 50 of the moment slab 48 and also secured to the elevated structure 95 to anchor the moment slab 48 to the structure 95 in order to prevent lateral movement of the vehicle barrier system 200 relative to the structure 95 on which the system 200 is installed. The lateral support members 56 may be secured to the support members 96 or to the horizontal structure 97 or another suitable component of the elevated structure 95. Such an installation may be utilized when installation on an earthen structure 84 or foundation 93 is not feasible. For instance, as shown in FIG. 14, such an installation may be utilized for dumping material from an elevated position onto a floating barge 99 positioned adjacent to a dock or wharf 98. FIGS. 11-14 illustrate various example installations of the vehicle barrier system 200, though one of skill in the art should appreciate that the present system 200 may be utilized for other applications in which a vehicle 76 is used for dumping material, which may include installation of the system 200 on other types of elevated structures.

It should be further appreciated by one skilled in the art that the length of the front curb section 12 and the lengths of the side curb sections 14 may be varied and still fall within the scope of the present disclosure. An appropriate length of the front curb section 12 disposed between the lower edges 30 of the front walls 22 of the side curb sections 14, which may generally define the width of the curb barrier that may be impacted by a vehicle 76 backing up to the front curb section 12, for a specific installation site may be determined by measuring the width of the specific type of vehicle 76 to be used at the site and then adding an allowance on either side of the vehicle 76 when the vehicle is centered between the side curb sections 14. For instance, the barrier structure 100 may preferably be constructed with the front curb section 12 having an allowance of approximately five feet (approximately 1.5 meters) on either side of a centered vehicle 76, which generally provides an operator of the vehicle sufficient clearance to position the vehicle between the side curb sections 14 without hitting the side curb sections 14 and also sufficient clearance to exit the vehicle 76, if needed. In addition, in some installations, one of the side curb sections 14 may alternatively have a different length than the opposing side curb section 14 and thus may extend farther from the front curb section 12 than the opposing side curb section.

In addition, as best seen in FIGS. 1 and 7, the height of the front curb section 12 above the moment slab 48 may be different than the height of the side curb sections 14 above the moment slab 48. An appropriate height of the front curb section 12 for a specific installation site may be determined based on the height of the rear axle of the specific type of vehicle 76 to be used at the site, as well as the height of a tail section of the dump bed of the vehicle 76 when the dump bed is in the fully dumped position. In addition, an appropriate thickness of the front curb section 12, which is defined by the distance between the front wall 18 and rear wall 20, for a specific installation site may be determined based on the weight of the specific type of vehicle 76 to be used at the site, the tire height of the vehicle 76, the tire wheelbase of the vehicle 76, and the extent of any cantilevered section 74 of the barrier structure 100. The minimum thickness of the front curb section 12 is preferably no less than fourteen inches (approximately 35 cm). It should be appreciated by one skilled in the art that these dimensions may be varied and still fall within the scope of the present disclosure.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the present disclosure.

What is claimed is:

1. A vehicle barrier system, comprising:

a barrier structure comprising a front curb section and two opposing side curb sections each connected to the front curb section, wherein each of the side curb sections extends from the front curb section at an angle to the front curb section, wherein the front curb section and side curb sections define a concrete form having a hollow interior, wherein the front curb section has a front wall and a rear wall, and wherein each of the side curb sections has a front wall and a rear wall, wherein the barrier structure includes a base attached to the rear wall of the front curb section and to each respective rear wall of the side curb sections, wherein the rear wall of the front curb section and each respective rear wall of the side curb sections extend upwardly from the base, wherein the front wall of the front curb section and each respective front wall of the side curb sections has a lower edge positioned above the base so as to define an open portion of the concrete form, wherein the barrier structure further comprises a plurality of vertical support members, wherein each respective vertical support member is connected to the base and to the lower edge of the front wall of the front curb section or to the lower edge of the front wall of a respective one of the side curb sections; and a moment slab connected to the front curb section and to the side curb sections, wherein at least a portion of the moment slab is disposed between the side curb sections, wherein the moment slab comprises concrete, wherein the concrete extends through the open portion of the concrete form and upwardly into the hollow interior of the concrete form.

2. The system of claim 1, wherein the front wall of each respective one of the side curb sections has a flared bottom section that is angled outwardly from an upper portion of the front wall as the flared bottom section approaches the moment slab.

3. The system of claim 1, further comprising a vertically oriented lateral support member having an upper end disposed within the concrete of the moment slab and a lower end disposed within an earthen support structure upon which the moment slab is positioned.

4. The system of claim 1, wherein each of the side curb sections extends from the front curb section at an angle of approximately 90 degrees to the front curb section.

5. The system of claim 1, wherein the moment slab has an upper surface that is generally level with the lower edge of the of the front wall of the front curb section and with the lower edge of each respective front wall of the side curb sections.

6. The system of claim 1, wherein the barrier structure further comprises a plurality of internal support members disposed within the hollow interior of the concrete form, wherein each respective internal support member is connected to the front wall and to the rear wall of the front curb section or is connected to the front wall and to the rear wall of a respective one of the side curb sections.

7. The system of claim 1, wherein the front curb section has an upper wall connecting the front wall and the rear wall of the front curb section, wherein the upper wall of the front curb section has a plurality of openings extending through the upper wall of the front curb section, wherein each of the side curb sections has an upper wall connecting the front wall and the rear wall of each respective one of the side curb sections, wherein the upper wall of each of the side curb sections has a plurality of openings extending through the upper wall of each of the side curb sections.

8. The system of claim 1, wherein the system further comprises a plurality of reinforcing bars disposed within the concrete.

9. The system of claim 1, wherein the system further comprises a plurality of precast concrete barriers each aligned with a respective one of the side curb sections.

10. The system of claim 1, wherein the base of the barrier structure is positioned above a top side of a retaining wall that retains soil of an earthen support structure upon which the moment slab is positioned.

11. The system of claim 10, wherein the retaining wall has a vertical exterior face, and wherein the rear wall of the front curb section is vertically aligned with the face of the retaining wall.

12. The system of claim 10, wherein the retaining wall has a vertical exterior face, and wherein the barrier structure is cantilevered such that a cantilevered section of the barrier structure extends past the face of the retaining wall.

13. The system of claim 10, wherein the system further comprises a spacer disposed between the base of the barrier structure and the top side of the retaining wall, wherein the spacer comprises an elastomeric material.

14. A method of comprising the steps of:

providing a concrete form comprising a front curb section and two opposing side curb sections each connected to the front curb section, wherein each of the side curb sections extends from the front curb section at an angle to the front curb section, wherein the front curb section has a front wall and a rear wall, and wherein each of the side curb sections has a front wall and a rear wall, wherein the barrier structure includes a base attached to the rear wall of the front curb section and to each respective rear wall of the side curb sections, wherein the rear wall of the front curb section and each respective rear wall of the side curb sections extend upwardly from the base, wherein the concrete form has a hollow interior, wherein the front wall of the front curb section and each respective front wall of the side curb sections has a lower edge positioned above the base so as to define an open portion of the concrete form that provides access to the interior;

preparing a generally flat subgrade surface;

placing the concrete form on the subgrade surface with the base laying horizontally on the subgrade surface;

positioning the concrete form so that the base of the concrete form is positioned above a top side of a retaining wall that retains soil of an earthen support structure;

installing a moment slab disposed at least partially between the side curb sections by pouring wet concrete slurry to form the moment slab, wherein the moment slab is positioned on the earthen support structure, wherein the concrete slurry extends through the open portion of the concrete form and into the interior of the concrete form, wherein the concrete slurry substantially fills the interior of the concrete form;

allowing the concrete slurry to cure to connect the moment slab to the front curb section and to the side curb sections;

providing a vehicle capable of dumping material;

backing the vehicle up to the front wall of the front curb section; and dumping material from the vehicle over the retaining wall.

15. The method of claim 14, wherein the system further comprises a vertically oriented lateral support member having an upper end disposed within the concrete of the moment slab and a lower end disposed within an earthen support structure upon which the moment slab is positioned, wherein the method further comprises the step of driving the lateral support member into the earthen support structure so that an upper end of the lateral support member is disposed above the subgrade surface before the step of pouring the concrete slurry to form the moment slab.

16. The method of claim 14, wherein the concrete form comprises a plurality of studs each attached to an inner surface of the concrete form and each disposed within the interior of the concrete form, wherein the method further comprises the step of installing reinforcing bars by inserting the reinforcing bars through the open section portion of the concrete form, tying the reinforcing bars to the studs, and positioning the reinforcing bars so that the reinforcing bars are disposed within the concrete of the moment slab after the step of pouring the wet concrete slurry to install the moment slab.

17. The method of claim 14, wherein each of the side curb sections extends from the front curb section at an angle of approximately 90 degrees to the front curb section.

* * * * *